US006841940B2

(12) United States Patent
Brady et al.

(10) Patent No.: US 6,841,940 B2
(45) Date of Patent: Jan. 11, 2005

(54) MAGNETRON ANODES

(75) Inventors: Michael B Brady, Maldon (GB); John W Kerr, Witham (GB)

(73) Assignee: E2V Technologies (UK) Limited (GB)

( * ) Notice: Subject to any disclaimer, the term of this patent is extended or adjusted under 35 U.S.C. 154(b) by 0 days.

(21) Appl. No.: 10/168,647

(22) PCT Filed: Dec. 21, 2000

(86) PCT No.: PCT/GB00/04945

§ 371 (c)(1),
(2), (4) Date: Nov. 4, 2002

(87) PCT Pub. No.: WO01/46981

PCT Pub. Date: Jun. 28, 2001

(65) Prior Publication Data

US 2003/0127987 A1 Jul. 10, 2003

(30) Foreign Application Priority Data

Dec. 21, 1999 (GB) ..... 9930109

(51) Int. Cl.[7] ..... H01J 23/22
(52) U.S. Cl. ..... 315/39.69; 315/39.75
(58) Field of Search ..... 315/39.51, 39.69, 315/39.75, 39.63

(56) References Cited

U.S. PATENT DOCUMENTS

| | | | | | |
|---|---|---|---|---|---|
| 3,553,524 | A | * | 1/1971 | Hill | 315/39.69 |
| 4,041,350 | A | * | 8/1977 | Shitara et al. | 315/39.75 |
| 4,056,756 | A | * | 11/1977 | Derby | 315/39.69 |
| 4,146,949 | A | * | 4/1979 | Derby, Jr. | 445/35 |
| 4,179,639 | A | * | 12/1979 | Derby | 315/39.69 |
| 4,288,721 | A | * | 9/1981 | Dodonov | 315/39.51 |
| 4,774,436 | A | * | 9/1988 | Clark et al. | 315/39.65 |
| 5,534,750 | A | * | 7/1996 | Theiss et al. | 315/5.35 |

* cited by examiner

*Primary Examiner*—Thuy Vinh Tran
(74) *Attorney, Agent, or Firm*—Kirschstein, et al.

(57) ABSTRACT

In a magnetron anode, an anode surrounds a central cathode. The anode is of a segmented structure having a plurality of annular segments stacked together along its length. Each annular segment includes a strap, the strap being distributed substantially along the entire axial length of the anode vanes. This enables mode separation to be achieved, even for long anode lengths and, hence, permits high power operation to be achieved. In addition, the segmented structure of the anode gives a mechanically robust design.

19 Claims, 7 Drawing Sheets

MAGNETRON ANODES

BACKGROUND OF THE INVENTION

This invention relates to magnetron anodes and more particularly, but not exclusively, to magnetron anodes able to operate at relatively high power levels.

In one known magnetron design, a central cylindrical cathode is surrounded by an anode structure which typically comprises a conductive cylinder supporting a plurality of anode vanes extensive inwardly from its interior surface. During operation, a magnetic field is applied in a direction parallel to the longitudinal axis of the cylindrical structure and, in combination with the electrical field between the cathode and anode, acts on electrons emitted by the cathode, resulting in resonances occurring and the generation of r.f. energy. A magnetron is capable of supporting several modes of oscillation depending on coupling between the cavities defined by the anode vanes, giving variations in the output frequency and power. One technique which is used to constrain a magnetron to a particular operating mode is that of strapping. To obtain and maintain the pi mode of operation, which is usually that is required, alternate anode vanes are connected together by straps. Typically, two straps are located at each end of the anode or in another arrangement, for example, there may be three straps at one end of the anode and none at the other.

The present invention arose from a consideration of in what way the output power of a magnetron might be increased but the invention may also be used in applications where this is not a requirement.

SUMMARY OF THE INVENTION

According to the invention, a magnetron anode comprises a plurality of stacked segments joined together to define anode vanes.

The segments are arranged generally transversely to the longitudinal axis and at least some of the segments have a shaped profile in the longitudinal direction, that is to say, they are not merely laminated sheets.

In one previously known type of magnetron anode, the anode comprises a single unitary component which is produced by machining from a solid block. For larger size anodes, a typical construction technique is to separately fabricate the anode vanes and then join them to a surrounding cylindrical anode shell using a jig to maintain alignment of the vanes with each other and the shell during the assembly procedure. In contrast to this, an anode in accordance with the invention has anode vane spacings which are accurately maintained because each segment includes a plurality of anode vane portions which are produced prior to the segments being stacked together. Hence any imperfections in a segment which might result in misalignment in the final assembly may be detected by inspection before it is joined with other segments and that segment rejected. Furthermore, use of the invention may lead to an anode which is more rugged, as the faces of the segments at which they are joined together are of relatively large surface area compared to the small fixing area involved where vanes are separately fabricated and fixed to the anode shell at their end faces.

In a preferred embodiment, each segment is a unitary component which may, for example, be machined from a solid material. Thus any processing during the assembly of the magnetron anode tends not to cause anode portions of a segment to move relative to one another because there are no joins in the segment itself. Also the completed magnetron anode is more likely to meet the ideal design dimensions than an anode fabricated in the previously known arrangement, and is more mechanically robust.

The other previously known method in which the anode is machined from a solid block is practicable for smaller anode designs but becomes more difficult and expensive to implement for larger anodes intended to be used in magnetrons at lower frequencies.

Preferably, the segments are substantially annular. Advantageously, each segment is a complete ring but, in other embodiments, each segment could comprise only part of a ring. However, this introduces additional complexity and numbers of components and is unlikely to be as convenient. Preferably, each segment has end faces which in the joined, stacked assembly lie in a plane transverse to the longitudinal axis of the generally cylindrical anode.

Preferably, a cylinder is disposed around and joined to the stacked segments. In other arrangements, instead of providing a separately fabricated cylinder, the segments themselves might include portions which in the finished anode assembly form the outer anode shell.

Advantageously, the anode includes a plurality of straps. In a particularly advantageous embodiment, straps are distributed along the axial length of the anode vanes. The segmented nature of the anode means that this can be readily accomplished and it brings significant advantages. Normally, strapping is only effective for anodes having axial length of one quarter of the operating wavelength. For longer anodes, mode separation breaks down and it becomes impossible to maintain the desired mode and frequency of operation. By distributing straps along the axial length of the anode vanes instead of, as is conventional, locating them at its ends, any desired length of anode may be used without loss of mode separation. Thus frequency stability may be retained whilst output power is increased, the output power being dependent on the length of the anode. It is believed, for example, that a magnetron using an anode in accordance with the invention and operating at X band may reach a power output in the region of 2 MW. However, magnetrons at other frequency ranges may also use the invention with advantage.

Advantageously, the straps are substantially uniformly spaced along the axial length of the anode vanes and preferably they are distributed along substantially the entire axial length. In effect, almost continuous strapping may be achieved for whatever length of anode is required.

The anode may include segments of different configurations. In one embodiment, for example, the segments define the anode vanes and the straps are provided as separate components. In a particularly advantageous embodiment, however, at least one of the segments includes a strap and portions of the anode vanes. Preferably, each segment includes a strap and portions of the anode vanes. This reduces the number of different component types required and hence facilitates manufacture and reduces costs. As the strap of each segment is integral with the anode vane portions, the anode is particularly robust in design.

In one arrangement, where a pair of adjacent segments are included which each have a strap, the strap of each segment is nearer to one end of the segment than to the other, and the segments are stacked adjacent one another with one being reversed with respect to the other. Thus one segment may include portions of half the number of the anode vanes which are joined together by its strap and the other segment comprises portions of the remaining anode vanes which are connected by its strap. The two segments are then placed next to each other in such a way that the portions of the anode vanes are interleaved and the positioning of the straps does not interfere with each other as they are at different points along the longitudinal axis of the anode. Preferably, the segments are nominally identical in form, easing manufacturing constraints.

According to a feature of the invention, a method of manufacturing a magnetron anode comprises the steps of: forming annular segments, each segment including portions of anode vanes; stacking the annular segments; and then joining the stacked segments together. The annular segments may be formed, for example, using electron discharge machining, although other techniques such as milling may be used. The annular segments may be joined, for example, by brazing.

The inventive method reduces fabrication time and is not as labour intensive as the previous method in which vanes are separately fabricated, in addition to leading to a particularly robust anode, with potential for high power use.

The anode may be formed in one method by stacking a plurality of annular segments and joining them together and then surrounding the assembly within a cylindrical shell which is joined to the stacked segments. The segments and cylinder may all be joined together in one step after the parts have been placed adjacent to one another. In an alternative method, a central core may be used around which the segments are placed and joined to the core. Following this step, part of the core may be removed, that part which remains forming portions of the anode vanes.

BRIEF DESCRIPTION OF THE DRAWINGS

Some ways in which the invention may be performed are now described by way of example with reference to the accompanying drawings in which.

DETAILED DESCRIPTION OF THE PREFERRED EMBODIMENT

Figure 1:
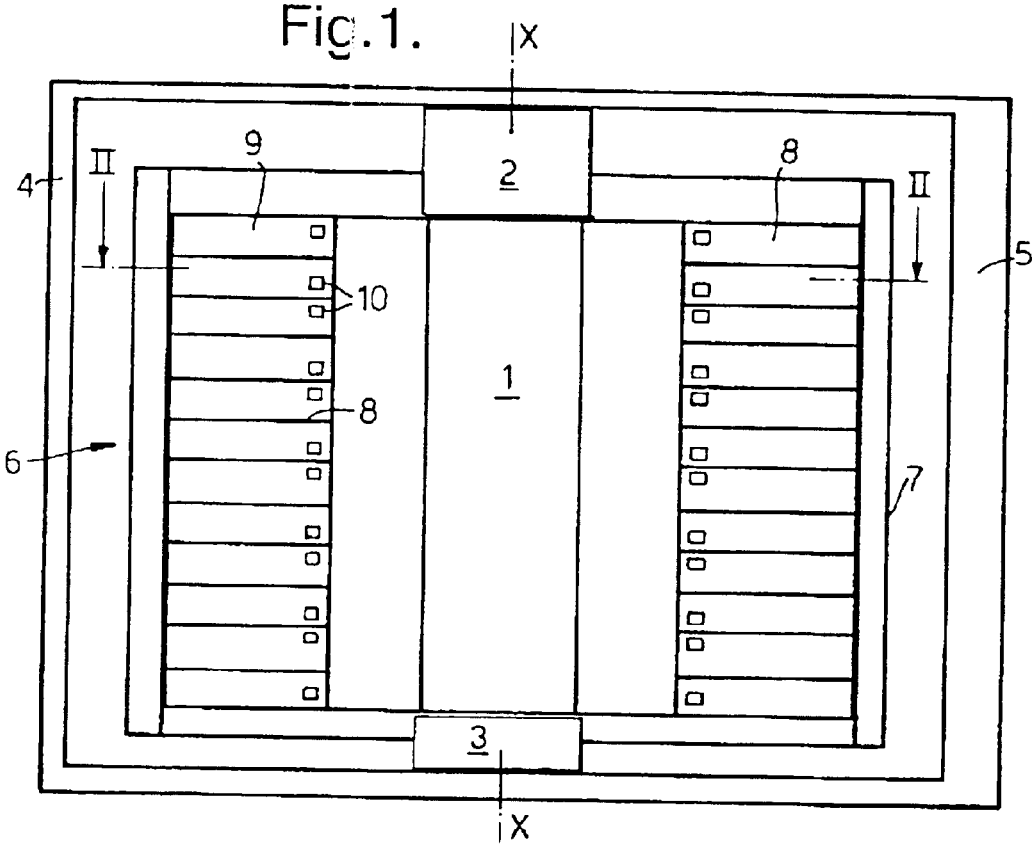
FIG. 1 is a schematic longitudinal section of a magnetron in accordance with the invention.
Figure 2:
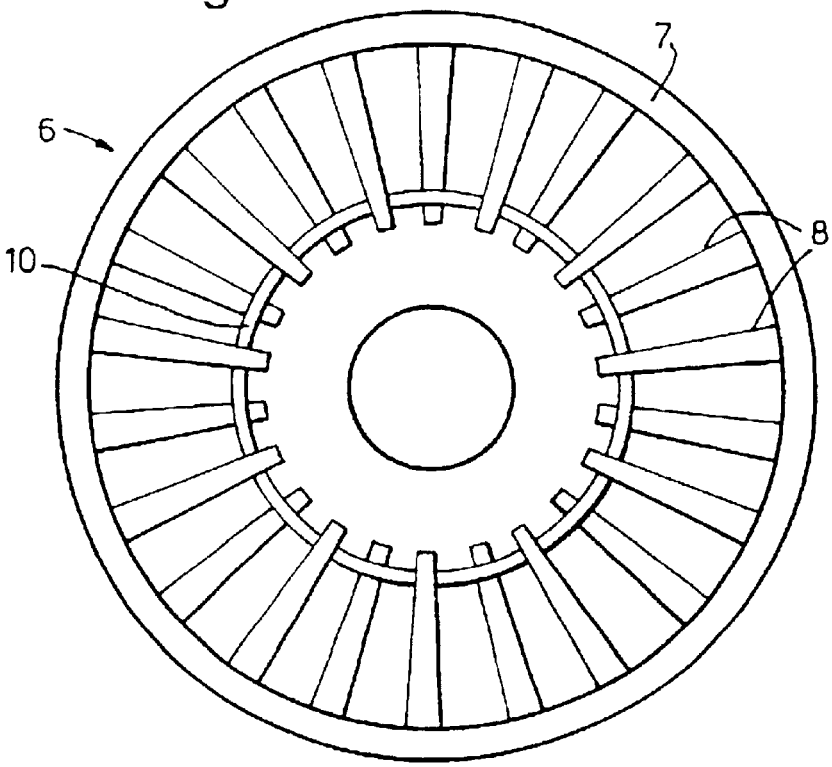
FIG. 2 is a plan view of the magnetron shown in FIG. 1 taken along the line II—II.

With reference to FIGS. 1 and 2, a magnetron in accordance with the invention comprises a cylindrical centrally located cathode 1 located between magnetic pole pieces 2 and 3 which are connected by magnetic return paths 4 and 5. The cathode 1 is surrounded by a cylindrical anode structure 6 comprising an outer shell 7 and inwardly extending anode vanes 8, the shell 7 and vanes 8 being of copper.

The vanes 8 are formed by a plurality of annular segments 9 which are stacked together along the longitudinal axis X—X of the magnetron. Each segment includes portions of half of the total number of anode vanes and a connecting ring which acts as a strap in the finished anode.

Figure 3:
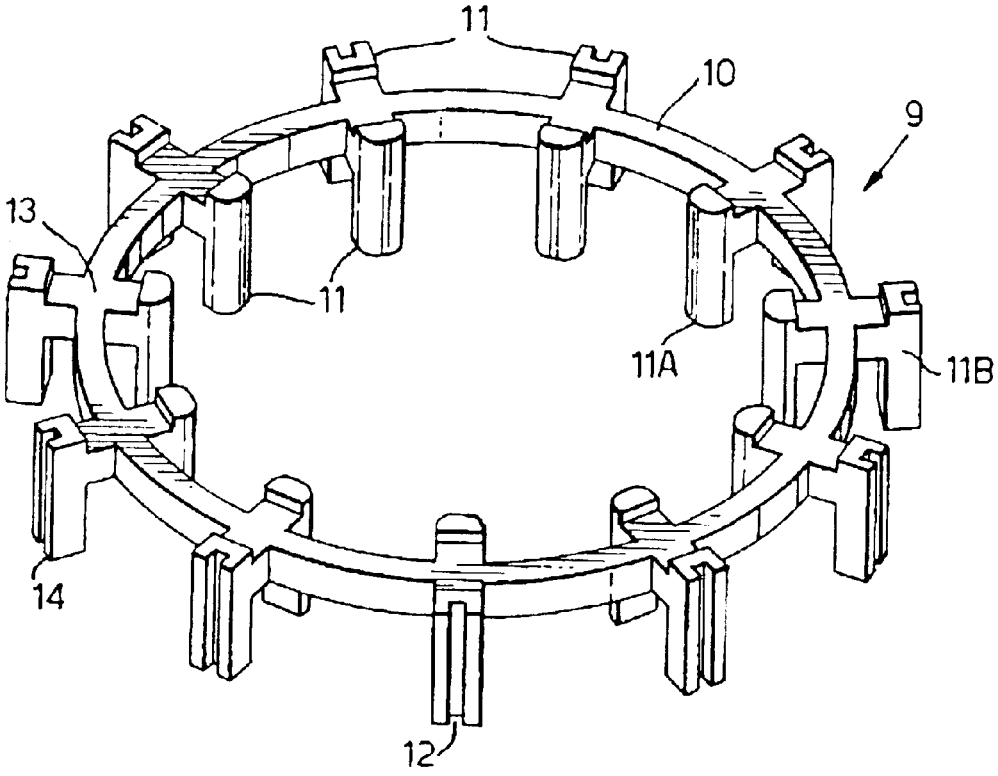
FIG. 3 shows one of the segments.

FIG. 3 shows schematically a single segment which is machined from a solid piece of copper by electron discharge machining. The segment 9 includes a complete ring 10 which forms the strap from which extends inwardly and outwardly portions 11 which in the finished structure form parts of the anode vanes 8. The inner parts 11A of the vane portions are rounded and in the finished device face the cathode 1. The outer parts 11B include a longitudinal groove 12 in their outer faces. As can be seen from the Figure, the strap is nearer one end 13 of the segment 9 than the other end 14.

Figure 5:
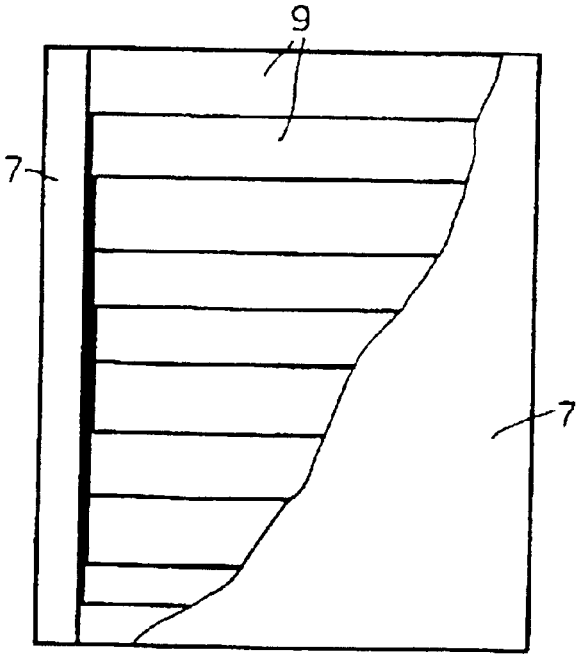
FIG. 5 shows the segments stacked together.
Figure 4:
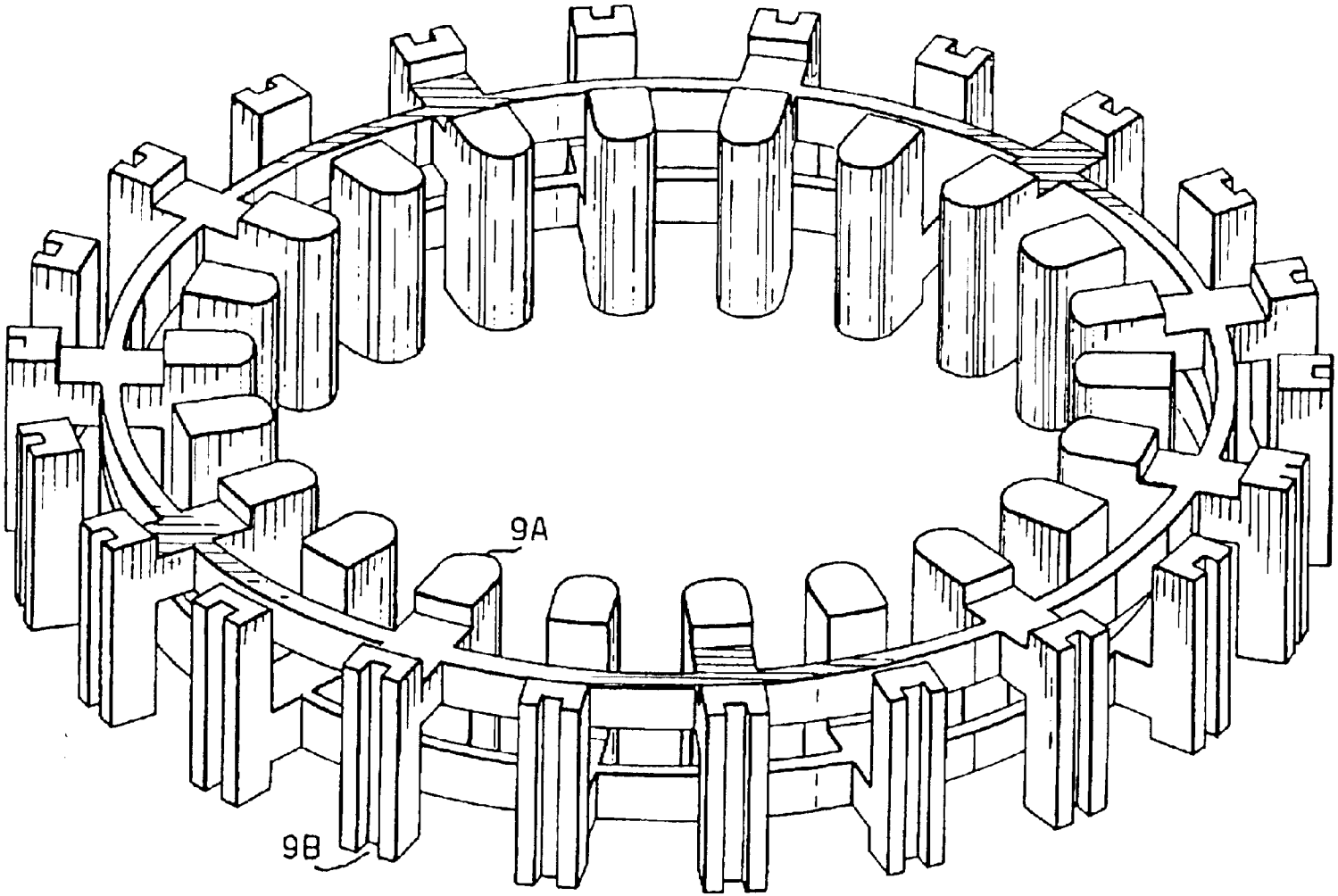
FIG. 4 shows two adjacent segments.

Following fabrication of a plurality of such segments 9, the next stage in the assembly is to coat their upper and lower surfaces with a layer of silver. The segments 9 are then assembled in a stack within the anode shell 7, one on top of the other to give a cylindrical structure. For each pair 9A, 9B of adjacent segments 9, one is reversed with respect to the other and also rotated relative to it as shown in FIG. 4, so that the vane portions are equidistantly spaced around the ring. The complete stack is shown schematically in FIG. 5. Braze material in the form of wires is fed down through the longitudinal grooves slots 12 in the outer surfaces of the segments 9. A jig is used to maintain the relative distances between adjacent anode vanes and the anode shell maintains the circular alignment.

After the components have been assembled, a weight is placed on the segments 9 and assembly heated. The silver on the adjoining faces of the segments melts and brazes them together and the segments are brazed also to the inner surface of the anode shell.

As many components as are required may be stacked together to form a long anode.

In this method, the segments 9 are identical. However, in other methods of assembly, several different components may be used in the anode assembly.

Figure 6:
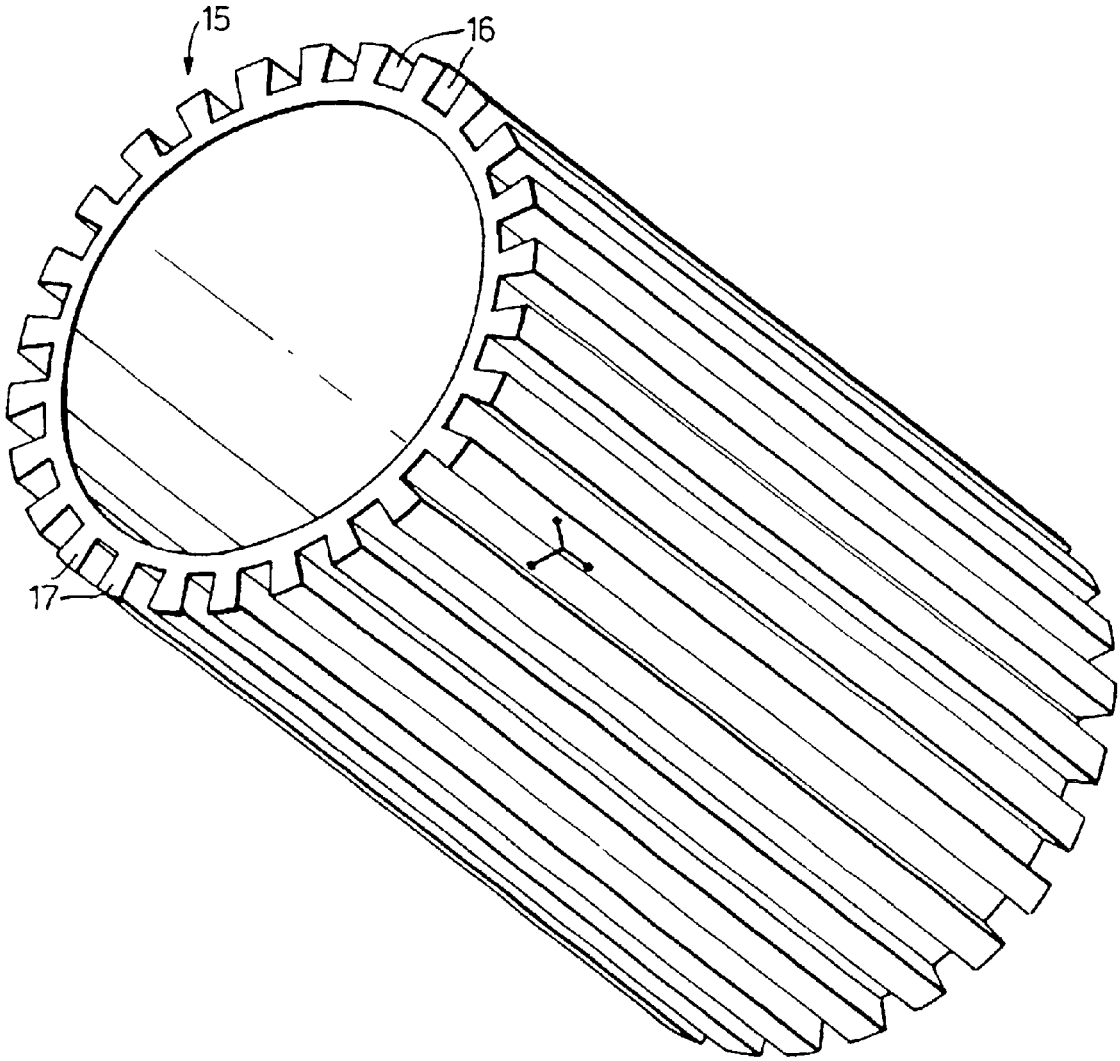
FIGS. 6, 7, 8, 9, 10, and 11 shows steps components used in other magnetron anode and manufacturing methods in accordance with the invention.
Figure 7:
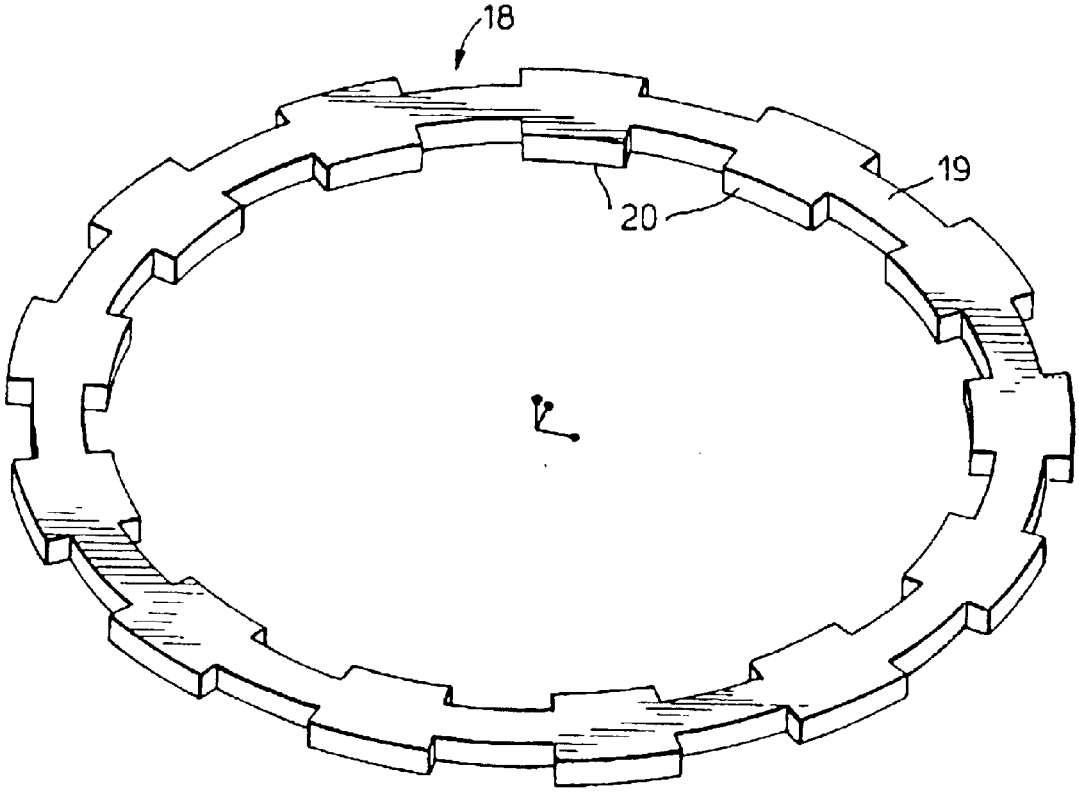
Figure 8:
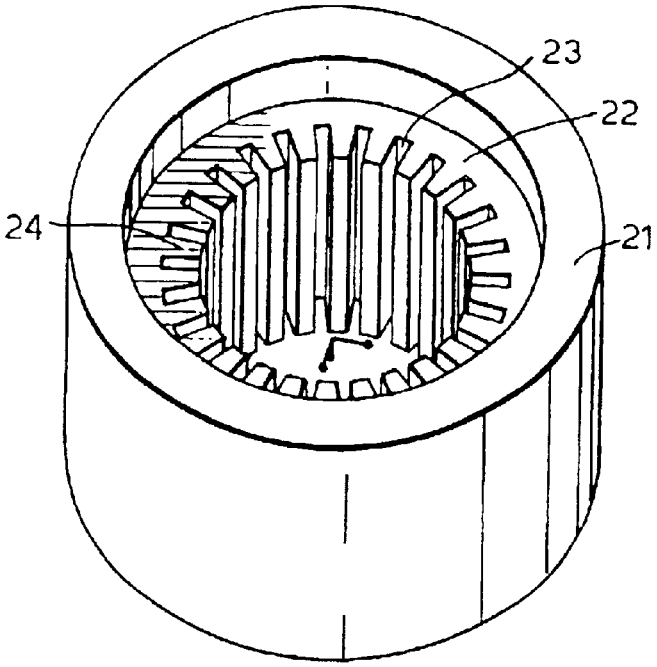

In another manufacturing method, first of all a cylindrical component as shown in FIG. 6 is machined. The component includes a central continuous cylindrical part 15 and grooves 16 defining ridges 17 around the outer surface. A plurality of segments 18 as shown in FIG. 7 are fabricated. Each segment includes a continuous ring 19 from which extend at intervals portions 20 inwardly and outwardly in a radial direction. Finally, a third component shown in FIG. 8 is produced having a continuous outer shell 21, which is the anode shell in the completed magnetron and an interior surface 22 having a plurality of grooves 23 therein to define vanes portions 24 between them. Each of the components is of copper with those surfaces which are to be joined to others coated with an appropriate braze material. The components shown in FIGS. 6 and 8 are arranged concentrically with a plurality of segments as shown in FIG. 7 located in the gap between them. The segments are rotationally displaced relative to adjacent segments so that alternate straps are electrically connected in the finished anode to the same anode vanes.

Figure 9:
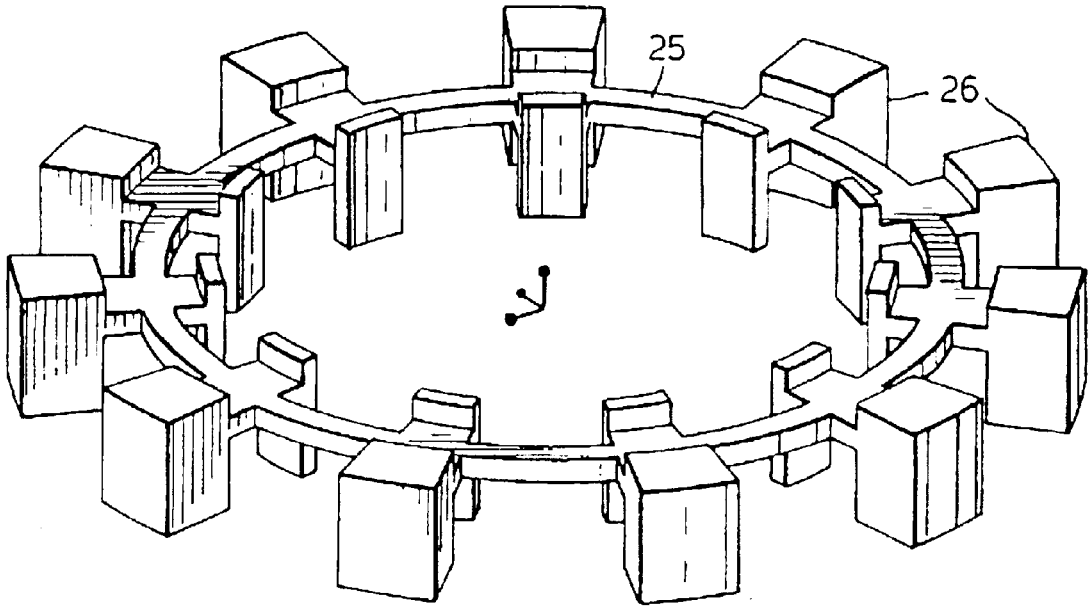
Figure 10:
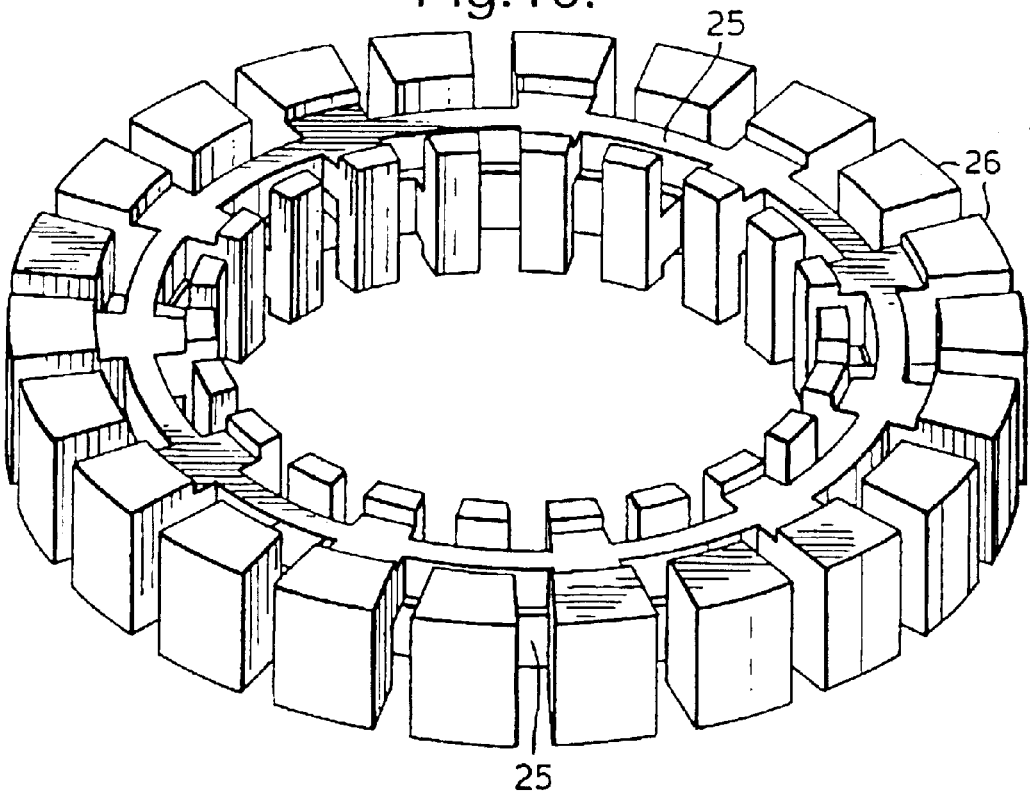

In another embodiment, first of all a segment as shown in FIG. 9 is machined having a complete ring 25, which is a strap in the finished magnetron, and a plurality of portions 26 extending therefrom which forms parts of the anode vanes. As in the other arrangements, the number of portions corresponds to half the total number of anode vanes in the finished magnetron. Pairs of the segments shown in FIG. 9 are assembled together as shown in FIG. 10 which are then stacked one on top of the other within a shell and brazed together.

Figure 11:
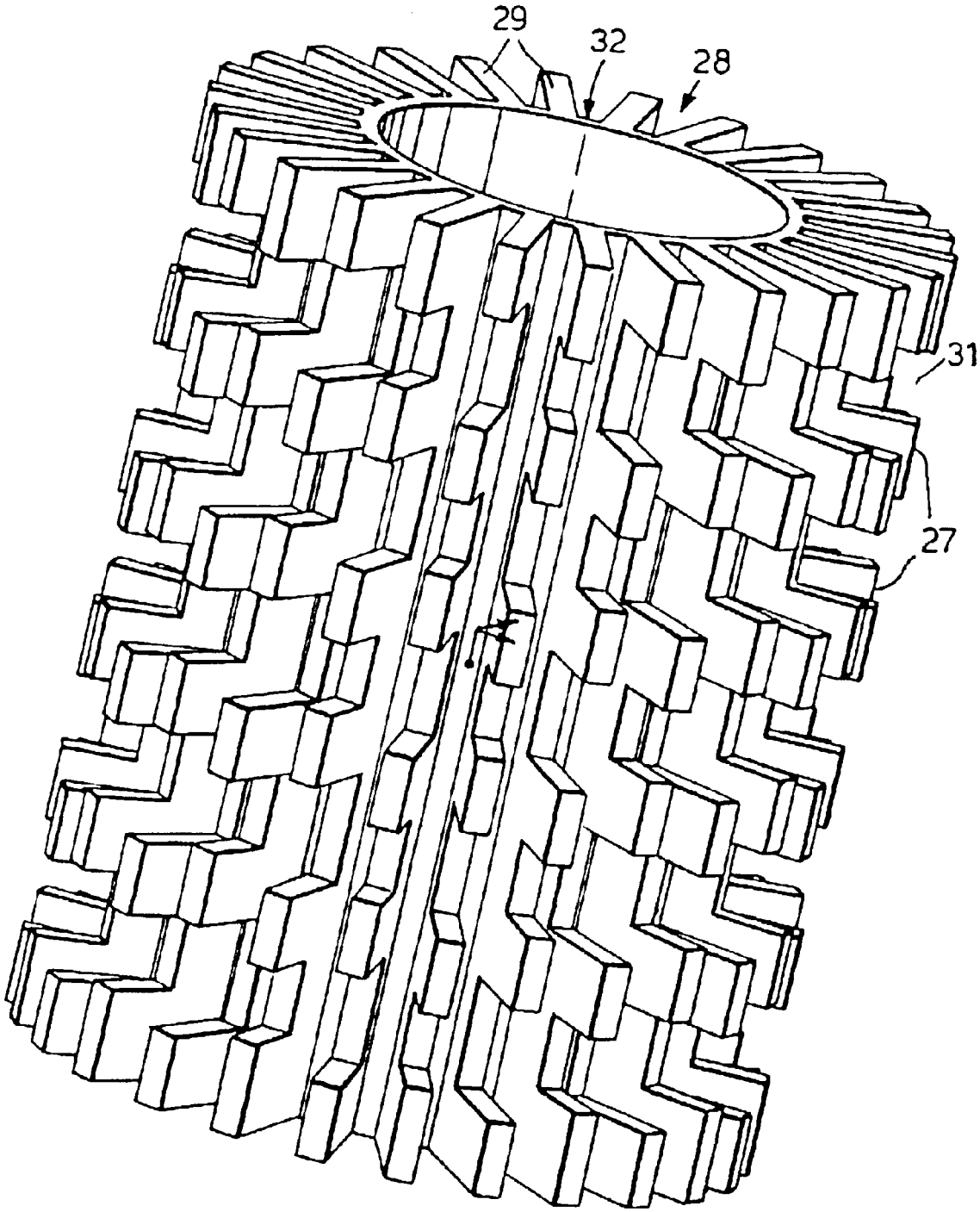

In an alternative method, and with reference to FIG. 11, a plurality of split rings 27 are assembled on a generally cylindrical former 28 having the inner part 29 of the anode vanes 30 around its outer surface. Grooves in the anode vanes shown for example at 31 receive the straps which are electrically connected to alternate vanes. The assembly is then placed within the component shown in FIG. 8 and brazed thereto. Finally, the central cylinder 32 is removed to give the final anode structure.

What is claim is:

1. A magnetron anode comprising a plurality of stacked segments joined together to define anode vanes, each of the segments including a strap and portions of the anode vanes, each segment comprising a ring from which extend portions at intervals inwardly and outwardly in a radial direction which form parts of the anode vanes, the straps being distributed substantially uniformly spaced along an axial length of the anode vanes.

2. The anode as claimed in claim 1 wherein at least one of the segments is a unitary component.

3. The anode as claimed in claim 1 wherein the segments are substantially annular.

4. The anode as claimed in claim 1 and including a cylinder around and joined to the stacked segments.

5. The anode as claimed in claim 1 wherein each segment has end faces which adjoin adjacent segments and lie in a plane transverse to a longitudinal axis of the magnetron anode.

6. The anode as claimed in claim 1 wherein the straps are distributed along a substantially entire axial length of the anode vanes.

7. The anode as claimed in claim 1 wherein, for a pair of adjacent segments which each include a strap, the strap of each segment is nearer one end than the other, and the segments are stacked with one reversed with respect to the other.

8. The anode as claimed in claim 7 wherein each segment includes portions of half of a total number of anode vanes, and wherein adjacent segments are arranged such that the portions of the anode vanes are interleaved.

9. The anode as claimed in claim 1 wherein the segments are nominally identical in form.

10. A method of manufacturing a magnetron anode comprising steps of forming annular segments, each segment including portions of anode vanes, each segment comprising a continuous ring from which extend portions at intervals inwardly and outwardly in a radial direction which form parts of the anode vanes; stacking the annular segments; and then joining the stacked segments together.

11. The method as claimed in claim 10 and including a step of locating a cylinder around and outside of the stacked annular segments, and a step of joining the segments to the cylinder.

12. The method as claimed in claim 10 and including a step of fabricating the segments using electron discharge machining.

13. The method as claimed in claim 10 wherein the step of joining the annular segments is performed by brazing.

14. The method as claimed in claim 10 wherein at least one of the segments includes a strap.

15. The method as claimed in claim 10 wherein, for a pair of adjacent segments, each segment includes a strap which is nearer one end of the segment than the other, and wherein the stacking of the segments is performed such that one segment is reversed with respect to the other segment.

16. The method as claimed in claim 10 wherein each of the segments includes a strap, and wherein the stacking of the segments is performed such that the straps are distributed along an entire axial length of the anode vanes.

17. The method as claimed in claim 10 wherein the annular segments are nominally identical in form.

18. The method as claimed in claim 10 and including steps of stacking the annular segments on a cylindrical core, then joining the segments to the core, and then removing part of the core, the annular segments and the cylindrical core that remain forming portions of the anode vanes.

19. A magnetron including a cathode coaxially surrounded by a magnetron anode, the anode comprising a plurality of stacked segments joined together to define anode vanes, each of the segments including a strap and portions of the anode vanes, each segment comprising a ring from which extend portions at intervals inwardly and outwardly in a radial direction which form parts of the anode vanes, the straps being distributed substantially uniformly spaced along an axial length of the anode vanes.

* * * * *